US008764476B1

(12) United States Patent
Ma

(10) Patent No.: US 8,764,476 B1
(45) Date of Patent: Jul. 1, 2014

(54) TRANSMISSION CONNECTOR

(71) Applicant: Frank Ma, Taipei (TW)

(72) Inventor: Frank Ma, Taipei (TW)

( * ) Notice: Subject to any disclaimer, the term of this patent is extended or adjusted under 35 U.S.C. 154(b) by 69 days.

(21) Appl. No.: 13/707,486

(22) Filed: Dec. 6, 2012

(51) Int. Cl.
*H01R 4/50* (2006.01)

(52) U.S. Cl.
USPC ..... 439/418; 439/676

(58) Field of Classification Search
USPC ..... 439/418, 676, 67, 77
See application file for complete search history.

(56) References Cited

U.S. PATENT DOCUMENTS

| | | | | |
|---|---|---|---|---|
| 5,967,828 | A | 10/1999 | Geurts et al. | |
| 5,989,071 | A | 11/1999 | Larsen et al. | |
| 6,010,353 | A | 1/2000 | Ensz et al. | |
| 6,010,371 | A * | 1/2000 | Farley et al. | 439/676 |
| 6,042,427 | A | 3/2000 | Adriaenssens et al. | |
| 6,113,400 | A | 9/2000 | Martin et al. | |
| 6,116,943 | A | 9/2000 | Ferrill et al. | |
| 6,123,572 | A | 9/2000 | Ishii et al. | |
| 6,244,906 | B1 | 6/2001 | Hashim et al. | |
| 6,276,954 | B1 | 8/2001 | Arnett et al. | |
| 6,319,069 | B1 | 11/2001 | Gwiazdowski | |
| 6,682,363 | B1 | 1/2004 | Chang | |
| 7,220,149 | B2 | 5/2007 | Pharney | |
| 7,249,979 | B2 | 7/2007 | Gerber et al. | |
| 7,425,159 | B2 | 9/2008 | Lin | |
| 7,556,536 | B2 | 7/2009 | Caveney et al. | |
| 2001/0012722 | A1 * | 8/2001 | Adams | 439/418 |
| 2008/0020652 | A1 * | 1/2008 | Caveney et al. | 439/676 |
| 2011/0237136 | A1 * | 9/2011 | Straka et al. | 439/676 |
| 2012/0238153 | A1 * | 9/2012 | Pachon et al. | 439/694 |

* cited by examiner

*Primary Examiner* — Gary Paumen
(74) *Attorney, Agent, or Firm* — Muncy, Geissler, Olds & Lowe, P.C.

(57) ABSTRACT

The transmission connector includes a base, a flexible circuit board and a cover. The base has a fixing seat with bendable tongues and a receiving seat. The flexible circuit board is received in the fixing seat and the receiving seat with abutting against the tongues. The cover includes a contact seat coupled to the fixing seat and having insulation-displacement contacts (IDCs). Bottoms of the IDCs are in contact with the flexible circuit board. The tongues generate elasticity force to push the flexible circuit board, so that the flexible circuit board can keep in electric contact with the IDCs.

9 Claims, 5 Drawing Sheets

TRANSMISSION CONNECTOR

BACKGROUND OF THE INVENTION

1. Technical Field

The present invention relates to electric connectors, particularly to transmission connectors which can reduce crosstalk.

2. Related Art

To satisfy the requirement of high speed data transmission, improving transmission speed and bandwidth is a primary solution. And to achieve the high speed transmission, besides computer facilities and transmission networks, transmission connectors with high performance are also required. However, crosstalk accompanied with the high speed transmission is one of the most serious problems affecting transmission performance.

There are many factors to cause crosstalk. A transmission connector with multiple wires is a primary factor. Because signals are transmitted through a plurality of wires which are parallelly and closely arranged in such a connector, crosstalk is easy to occur between two adjacent wires due to inductive coupling. Typical solutions to crosstalk in a connector are shielding and wrapped twisted pair. But these solutions cannot completely overcome the problem of crosstalk.

U.S. Pat. No. 6,116,943 discloses a structure which adds a rigid circuit board in a modularized plug. The rigid circuit board is provided with holes arranged in matrix form for insertion of wires and pins. Besides, the circuit board is also provided with a wiring layout which can reduce crosstalk.

However, crosstalk results from not only inductive coupling between two adjacent wires, but also cross-section areas of two adjacent wires. Even the latter generates more serious crosstalk than the former. Thus, the above-mentioned solutions have not been able to effectively reduce crosstalk.

SUMMARY OF THE INVENTION

A primary object of the invention is to provide a transmission connector which has a small cross-section area so as to effectively reduce crosstalk.

Another object of the invention is to provide a transmission connector which uses structural stress to fasten the flexible circuit board and to keep electric connection of the flexible circuit board and pins so that a soldering process can be saved.

To achieve the above objects, the transmission connector of the invention includes a base, a flexible circuit board and a cover. The base has a fixing seat with bendable tongues and a receiving seat. The flexible circuit board is received in the fixing seat and the receiving seat with abutting against the tongues. The cover includes a contact seat coupled to the fixing seat and having insulation-displacement contacts (IDCs). Bottoms of the IDCs are in contact with the flexible circuit board. The tongues generate elasticity force to push the flexible circuit board, so that the flexible circuit board can keep in electric contact with the IDCs.

DETAILED DESCRIPTION OF THE INVENTION

Figure 1:
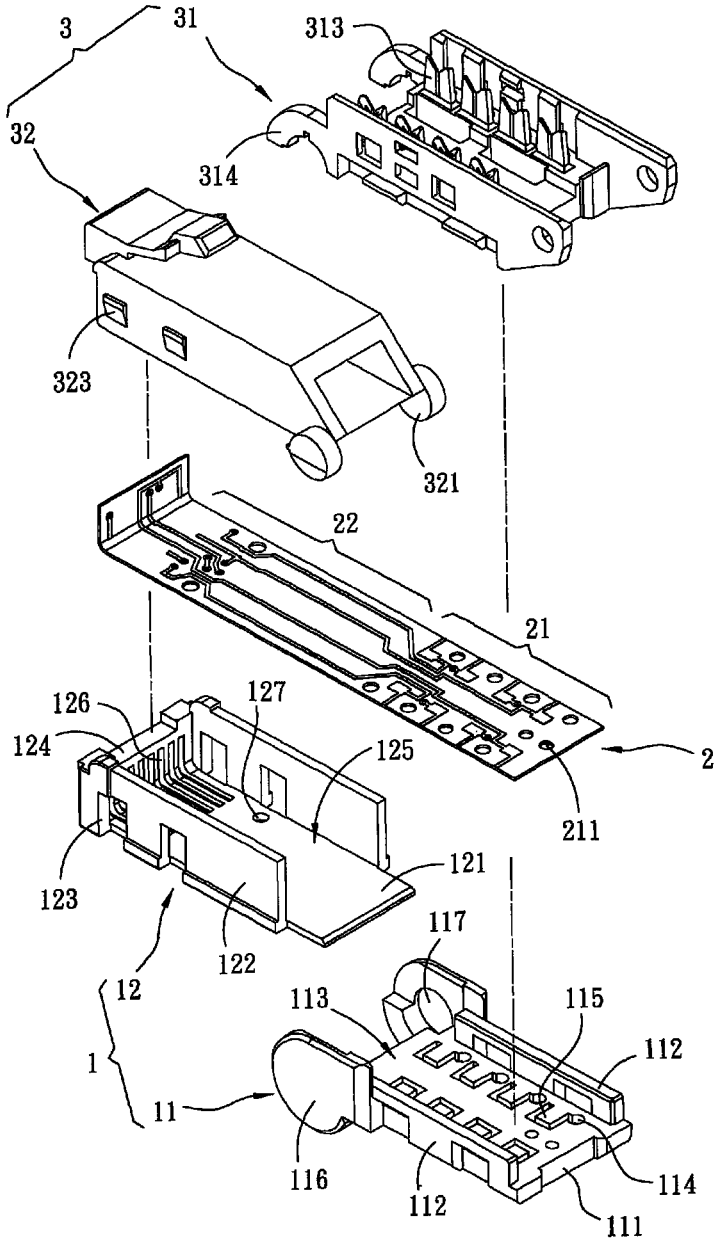
FIG. 1 is an exploded view of the invention.
Figure 2:
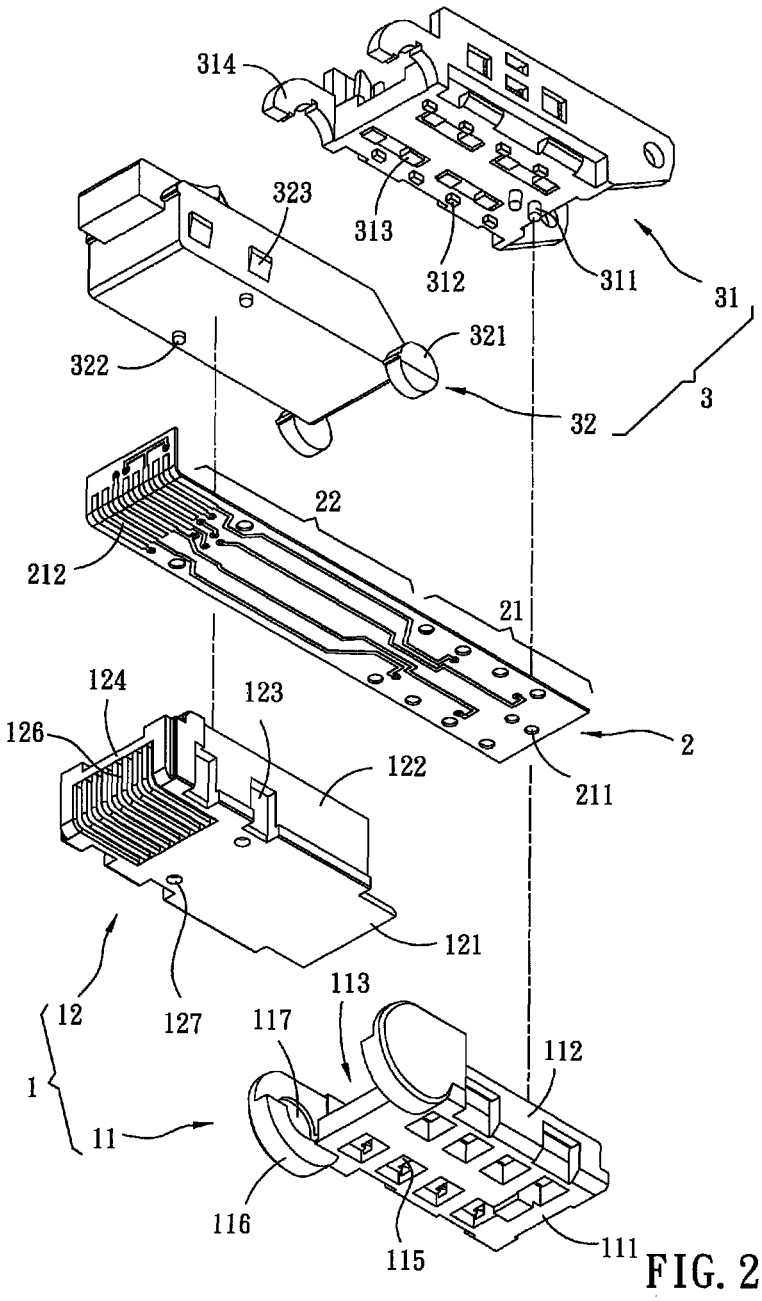
FIG. 2 is another exploded view of the invention.

Please refer to FIGS. 1 and 2. The transmission connector of the invention includes a base 1, a flexible circuit board 2 and a cover 3. The base 1 is composed of a fixing seat 11 and a receiving seat 12. The fixing seat 11 has an elongated plate 111 and two side walls 112 on two long edges of the elongated plate 111. A receiving room 113 is defined by the side walls 112 and plate 111. The plate 111 is formed with a plurality of insertion holes 114 and tongues 115 separately adjacent to the insertion holes 114. These tongues 115 are flexibly bendable. An gripping sheet 116 extends from an end of each of the side walls 112. An inner side of the gripping sheet 116 is formed with a semicircular recess 117. The receiving seat 12 is coupled to the fixing seat 11 with the gripping sheets 116. The receiving seat 12 has a board 121 and two parallel fixing sheets 122. Each of the fixing sheets 122 is provided with at least one engagement hole 123 which is located near the board 121. In the shown embodiment, there are a plurality of engagement holes 123 in a fixing sheet 122. The other end of the board 121 is formed with an end sheet 124. A receiving space 125 is defined by the end sheet 124 and board 121. Additionally, the board 121 is formed with through slots 126. The through slots 126 extend to the end sheet 124. The board 121 is further formed with passing holes 127.

The flexible circuit board 2 is a thin conductive film and has a printed circuit. The flexible circuit board 2 is composed of a fixed section 21 and a bending section 22. The fixed section 21 is received in the receiving room 113 of the fixing seat 11. The flexible circuit board 2 is provided with through holes 211. The through holes 211 in the fixed section 21 and bending section 22 correspond to the insertion holes 115 and passing holes 127 in position, respectively. The bending section 22 is received in the receiving seat 12 and of an L-shape so that the bending section 22 abuts against the board 121 and end sheet 124. The bending section 22 is provided with wires 212 corresponding to the through slots 126 in position so that the wires 212 can be separately exposed in the through slots 126.

Figure 3:
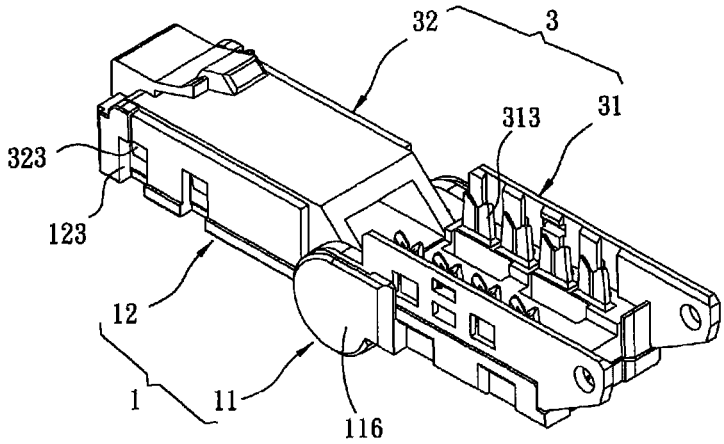
FIG. 3 is a perspective view of the invention.
Figure 7:
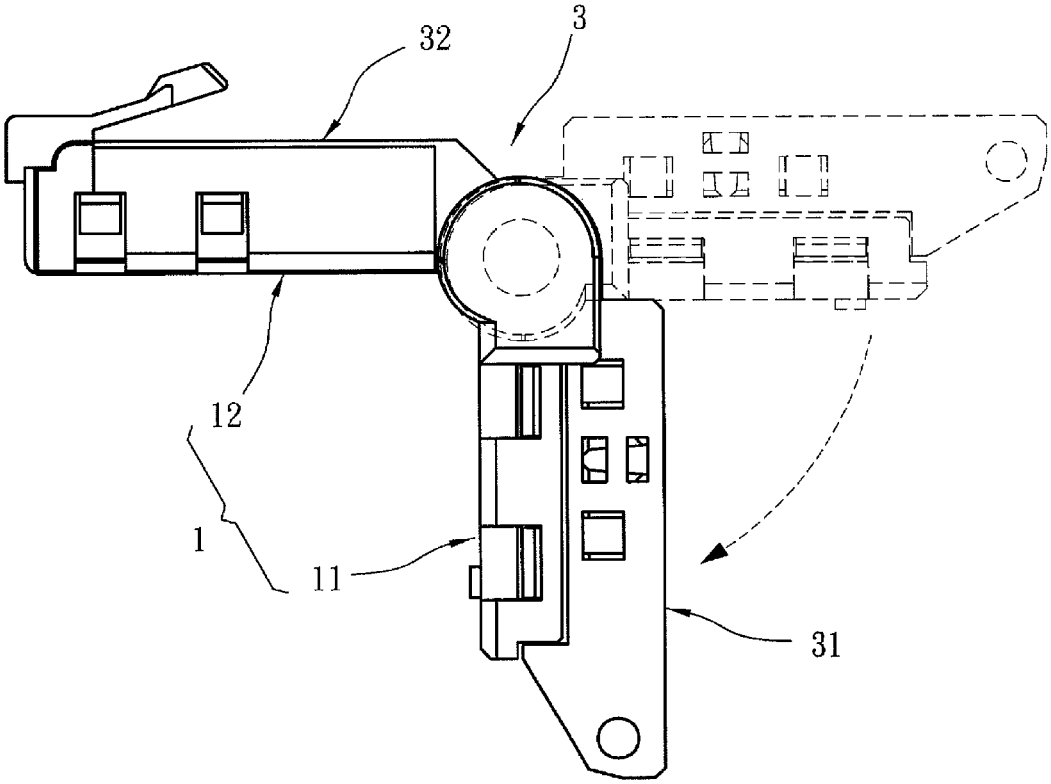
FIG. 7 is a schematic view of the invention to show the operation.

The cover 3 is fastened to the base 1. The flexible circuit board 2 is securely nipped between the cover 3 and base 1. The cover 3 is composed of a contact seat 31 and a connecting seat 32. The contact seat 31 is used for receiving external wires and is coupled to the fixing seat 11. The bottom of the contact seat 31 is formed with bars 311 and blocks 312. These bars 311 and blocks 312 pass through the through holes 211 and insertion holes 115, respectively. Thus the fixed section 21 of the flexible circuit board 2 is secured in the fixing seat 11 and contact seat 31. The contact seat 31 is formed with insulation-displacement contacts (IDCs) 313. The IDCs 313 are made of a conductive material and protrude from the contact seat 31 for being in contact with the flexible circuit board 2 to make electric connection. Two arms 314 extend from an end of the contact seat 31. The arms 314 engage with the recesses 117 of the gripping sheets 116. The connecting seat 32 is coupled to the receiving seat 12. An end of the connecting seat 32 is disposed with two wheels 321 received in the recesses 117. When the arms 314 have been coupled to the gripping sheets 116, the wheels 321 are covered by them so that the connecting seat 32, receiving seat 12 and bending section 22 of the flexible circuit board 25 can be rotated as shown in FIG. 7. The bottom of the connecting seat 32 is formed with inserts 322. The inserts 322 pass through the through holes 211 and passing holes 127 to secure the bending section 22 of the flexible circuit board 2 in the connecting seat 32 and receiving seat 12. Each of two sides of the connecting seat 32 is formed with at least one protrusion 323. In the shown embodiment, there are a plurality of protrusions 323. The protrusions 323 are used for engaging with the engagement holes 123 so as to secure the connecting seat 32 and receiving seat 12 as shown in FIG. 3.

Figure 4:
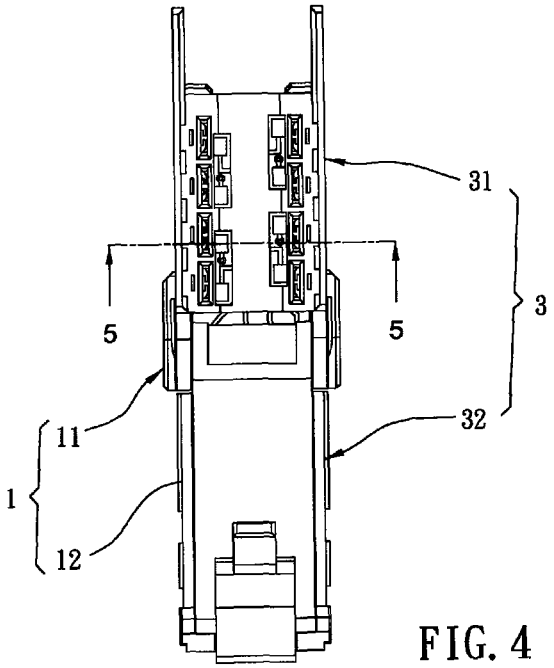
FIG. 4 is a top plan view of the invention.
Figure 5:
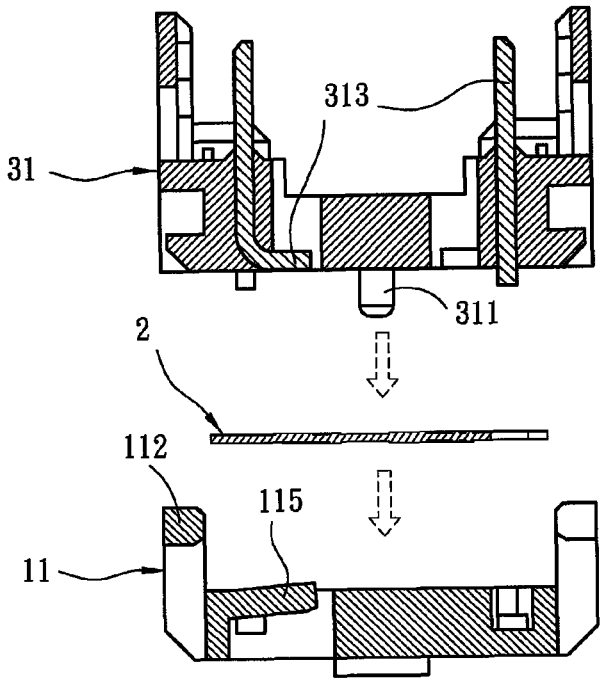
FIG. 5 is an exploded cross-sectional view of the invention along line 5-5.
Figure 6:
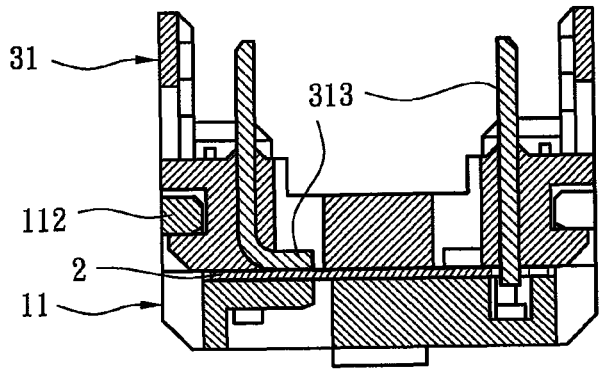
FIG. 6 is an assembled cross-sectional view of the invention along line 5-5.

Please refer to FIGS. 4-6. Because the tongues 115 are flexibly bendable as shown in FIG. 5, when the contact seat 31 presses the fixed section 21 of the flexible circuit board 2 in the fixing seat 11 and uses the bars 311 to generate pressure, the tongues 115 will be pressed by the contact seat 31 to move downward and will form upward stress to press the flexible circuit board 2 as shown in FIG. 6. This can directly connect the IDCs 31 onto the flexible circuit board 2 without using a pressing or soldering process.

It will be appreciated by persons skilled in the art that the above embodiment has been described by way of example only and not in any limitative sense, and that various alterations and modifications are possible without departure from the scope of the invention as defined by the appended claims.

What is claimed is:

1. A transmission connector comprising:

a base comprising:

a fixing seat, having a plate with a plurality of tongues, and the tongues being bendable; and a receiving seat, connected to the fixing seat, and being formed with through slots;

a flexible circuit board, received in the fixing seat and the receiving seat, abutting against the tongues, and having wires corresponding to the through slots for exposing the wires in the through slots; and a cover coupled to the base, comprising:

a contact seat, coupled to the fixing seat, and having a plurality of insulation-displacement contacts (IDCs), wherein bottoms of the IDCs are in contact with the flexible circuit board; and a connecting seat, coupled to the receiving seat and the fixing seat;

whereby a connection of the contact seat and the fixing seat generates pressure onto the flexible circuit board and the tongues generate elasticity force to push the flexible circuit board, so that the flexible circuit board keeps in electric contact with the IDCs.

2. The transmission connector of claim 1, wherein two gripping sheets extend from an end of the fixing seat, and an inner side of each of the gripping sheets is formed with a recess.

3. The transmission connector of claim 2, wherein an end of the connecting seat is disposed with two wheels separately received in the recesses.

4. The transmission connector of claim 3, wherein two arms extend from an end of the contact seat, the arms engage with the recesses of the gripping sheets, and the wheels are covered by the arms, so that the connecting seat and the receiving seat can be rotated.

5. The transmission connector of claim 1, wherein the fixing seat and the receiving seat are formed with insertion holes and passing holes, respectively.

6. The transmission connector of claim 5, wherein the flexible circuit board is provided with through holes separately corresponding to the insertion holes and passing holes in position.

7. The transmission connector of claim 6, wherein a bottom of the contact seat is formed with bars and blocks, a bottom of the connecting seat is formed with inserts the bars, and the inserts and the blocks pass through the through holes and insertion holes.

8. The transmission connector of claim 1, wherein the receiving seat has a board and two parallel fixing sheets, each of the fixing sheets is provided with at least one engagement hole which is located near the board.

9. The transmission connector of claim 8, wherein each of two sides of the connecting seat is formed with at least one protrusion for engaging with the engagement holes so as to secure the connecting seat and receiving seat.

* * * * *